US007721556B2

(12) United States Patent
Guida

(10) Patent No.: US 7,721,556 B2
(45) Date of Patent: May 25, 2010

(54) SINGLE-USE, SELF-HEATING OR SELF-COOLING CONTAINER, PARTICULARLY FOR BEVERAGES AND METHOD FOR MANUFACTURING THE SAME

(75) Inventor: Francesco Guida, Naples (IT)

(73) Assignee: Guida & C. S.p.A., Naples (IT)

( * ) Notice: Subject to any disclaimer, the term of this patent is extended or adjusted under 35 U.S.C. 154(b) by 1280 days.

(21) Appl. No.: 10/526,483

(22) PCT Filed: Sep. 5, 2002

(86) PCT No.: PCT/IT02/00567

§ 371 (c)(1),
(2), (4) Date: Sep. 22, 2005

(87) PCT Pub. No.: WO2004/022450

PCT Pub. Date: Mar. 18, 2004

(65) Prior Publication Data

US 2006/0086097 A1 Apr. 27, 2006

(51) Int. Cl.
*F25D 5/00* (2006.01)

(52) U.S. Cl. ..... 62/4

(58) Field of Classification Search ..... 62/4, 62/60, 330

See application file for complete search history.

(56) References Cited

U.S. PATENT DOCUMENTS

| | | | | |
|---|---|---|---|---|
| 2,925,719 | A | | 2/1960 | Linn et al. |
| 5,461,867 | A | * | 10/1995 | Scudder et al. ..... 62/4 |
| 5,628,304 | A | | 5/1997 | Freiman |

FOREIGN PATENT DOCUMENTS

| | | |
|---|---|---|
| EP | 0 015461 | 9/1980 |
| EP | 0 255 494 | 2/1988 |
| GB | 2 131 542 | 6/1984 |

* cited by examiner

*Primary Examiner*—Melvin Jones
(74) *Attorney, Agent, or Firm*—Young & Thompson

(57) ABSTRACT

A single-use, self-heating or self-cooling container, particularly for beverages, producible in a plurality of sizes, comprises a first receptacle (2) containing a beverage and inserted into a second receptacle (3), a first compartment (11) formed between the first and the second receptacle and a second compartment (12) formed on the base of the second receptacle and separated from the first compartment by a breakable diaphragm (13). In these compartments (11, 12) are separately and respectively arranged at least a first and a second component of an exothermic or endothermic reaction, and the first component is arranged in the first compartment (11) annularly around the first receptacle (2), while the diaphragm (13) extends as a separation of these compartments substantially against the base (4) of the first receptacle.

18 Claims, 5 Drawing Sheets

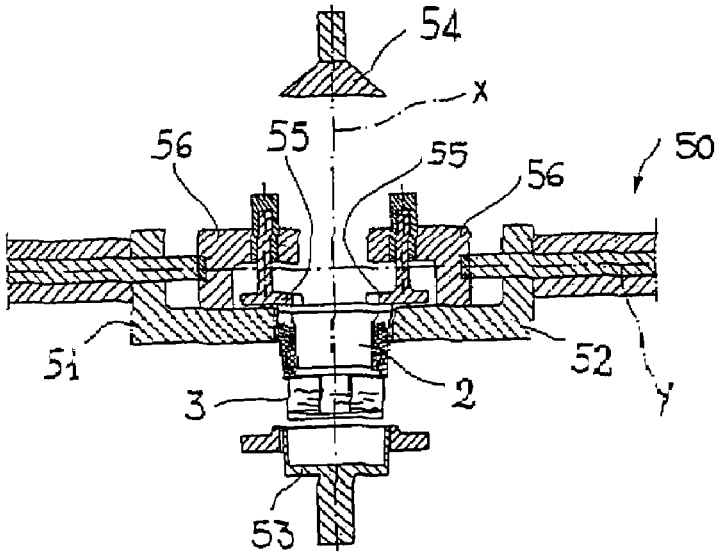
Fig. 5d
Fig. 5e
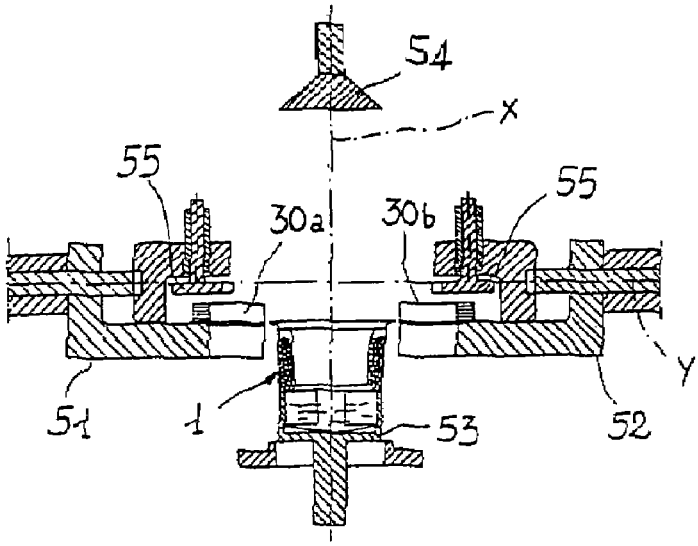

SINGLE-USE, SELF-HEATING OR SELF-COOLING CONTAINER, PARTICULARLY FOR BEVERAGES AND METHOD FOR MANUFACTURING THE SAME

TECHNICAL FIELD

This invention relates to a single-use, self-heating or self-cooling container, particularly for beverages, producible in a plurality of sizes according to the preamble of the main claim. This invention also presents a method for manufacturing such a container.

TECHNICAL BACKGROUND

The invention is situated in the field of containers in which means are provided to obtain heating or cooling of the beverage as a result of an exothermic or endothermic chemical reaction.

In this technical field, containers for beverages are known in which the components of this chemical reaction are arranged separately in respective compartments of a chamber formed between a first receptacle, containing the beverage, and a second outer receptacle into which the first receptacle is inserted. The components mentioned above generally consist of a liquid and a salt, present in granular form, and the reaction between them is initiated by tearing a diaphragm separating the two compartments, for example by means of a breaking device integral with an inward-flexing base of the second receptacle.

To optimize the effectiveness of the reaction, the compartment of the chamber in which the salt is arranged is formed directly in contact with all the available surface of the first receptacle, while the compartment intended to contain the liquid component is made on the base of the second receptacle, without direct contact with the first receptacle.

This preferred arrangement of the components meets the requirements of making the reaction take place as far as possible in contact with the first receptacle, at the same time utilising the greater ability of the liquid component to pass through the break produced in the diaphragm.

A first limit of the known containers consists in the fact that the container as a whole is relatively bulky in relation to the quantity of beverage contained in the first receptacle.

One of the reasons for this disadvantage is given by the fact that the salt component is placed between the breakable diaphragm and the base of the first receptacle, keeping these at a distance from each other. At the same time, the portion of the relevant compartment extending annularly around the side jacket of the first receptacle is unoccupied.

This arrangement is a direct consequence of the procedure for manufacturing the container which provides for the salt component to be introduced into the respective compartment before introducing the first receptacle. The salt component is therefore arranged above the diaphragm and the first receptacle cannot but rest on the layer of salt component already introduced.

On the other hand, the space between the diaphragm and the base of the first receptacle is also considered necessary so that the breaking device, typically made of rigid material to tear the diaphragm more easily, can penetrate into the compartment of the salt component without being impeded by the base of the first receptacle.

The above arrangement is also the source of a second important disadvantage of the known containers. This is that they are only suitable for containing relatively small quantities of beverage, up to 50 ml, beyond which the dimensions and overall weight of the containers are so great, when compared with the actual quantity of beverage, as to render them commercially impracticable.

In fact it has been found that increasing the quantity of beverage contained, and therefore of the reagents necessary to heat (or cool) it, also involves a drastic increase in the unused spaces between the first and the second container, with a resulting rise in the fraction of thermal energy dissipated to the outside or absorbed by the components of the container. To compensate for the greater wastage of energy not used for the actual heating of the beverage, it therefore becomes necessary to use a quantity of reagents far greater than the increase determined by the actual amount of beverage.

In other words, the increase in the dimensions and overall weight of the container is not proportional to the increase in the amount of beverage to be heated or cooled, but much greater than it.

This disadvantage, besides setting an important limit to the marketing of containers with average quantities of beverage (greater than 50 ml), as stated earlier, also involves technical complications in manufacturing and a rise in production costs.

DESCRIPTION OF THE INVENTION

The problem at the basis of the invention is that of producing a single-use, self-heating or self-cooling container, particularly for beverages, producible in a plurality of sizes, structurally and functionally designed to overcome the limits set out above with reference to the prior art cited. In connection with this problem, a main purpose of the invention is to produce a container which is compact overall and low-cost, in which the exothermic or endothermic reaction takes place, when initiated, with greater overall thermal efficiency compared with the current solutions.

Moreover, a primary purpose of the invention is to make available a method for manufacturing such a container. These and other purposes, which will become clear in the rest of the description, are achieved by a single-use, self-heating or self-cooling container, producible in a plurality of sizes, and also by a method for manufacturing such a container in accordance with the claims which follow.

BRIEF DESCRIPTION OF THE DRAWINGS

The characteristics and advantages of the invention will become clear from the detailed description of some preferred examples of embodiments illustrated, purely by way of non-limiting example, with reference to the appended drawings in which:

FIGS. 5*a* to 5*e* are schematic views of respective stages in production of the container in FIG. 1 according to a second method of manufacturing the container.

PREFERRED EMBODIMENTS OF THE INVENTION

With reference to the appended drawings, the number 1 indicates as a whole a single-use, self-heating or self-cooling container, for beverages, producible in a plurality of sizes, obtained in accordance with this invention. The container 1 comprises a first and a second receptacle 2, 3, the first of which is inserted coaxially inside the second and is connected to the latter at the respective mouths.

Figure 1:
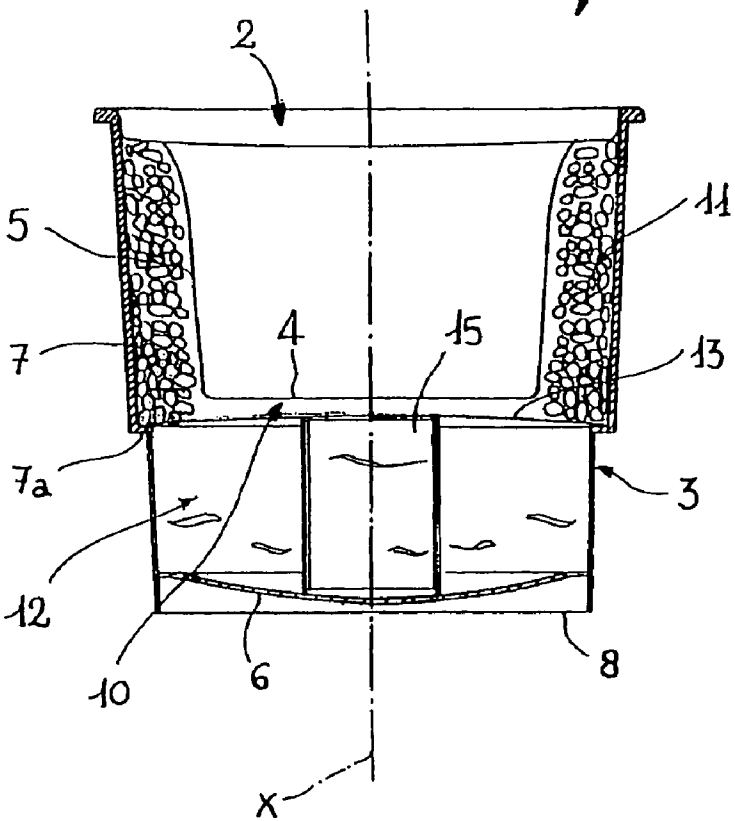
FIG. 1 is a view in front elevation and in partial section of a single-use, self-heating or self-cooling container, particularly for beverages, producible in a plurality of sizes, produced according to this invention, in a first operating state.

On the first receptacle 2, intended to contain the beverage and being substantially cylindrical in shape, there is a substantially flat base 4, and a side casing 5. Similarly, on the second receptacle 3, having a similar tumbler shape, there is a base 6, with an outwardly convex shape (FIG. 1) and a side casing 7 substantially parallel to the casing 5 of the first receptacle 2. To provide the container 1 with a stable seating, the base 6 is surrounded by a collar 8 extending axially from the opposite side to the casing 7.

Figure 2:
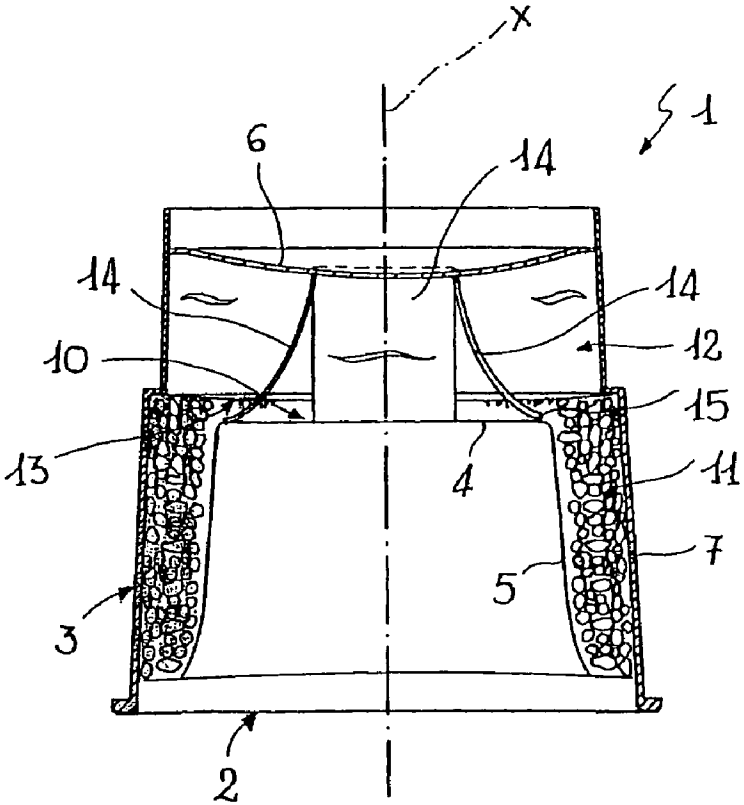
FIG. 2 is a view of the container in FIG. 1 in a second operating state and in an upside down position.

As specified more fully below, the base 6 is capable of changing from a rest position in which it is dished outwards (FIG. 1) to an operating position in which it is dished inwards (FIG. 2).

The second receptacle 3 is closed at the mouth end by the first receptacle 2, while the latter is closed removably by a pull-off cover.

Between the receptacles 2 and 3 a chamber 10 is thus formed, closed in a sealed manner to the outside, which is divided into a first and a second compartment 11, 12 by a breakable diaphragm 13 secured at its perimeter edge to a shoulder 7*a* of the casing 7.

The diaphragm 13 extends transversely in the chamber 10 against the base 4 of the first receptacle 2 and in a manner substantially parallel to the base. The first compartment 11 therefore predominantly extends around the casing 5 of the first receptacle 2 in a substantially annular shape.

The second compartment 12 is formed on the base 6 of the second receptacle 3, bounded at the top by the diaphragm 13.

In the compartments 11 and 12 there are arranged separately and respectively a first and a second component capable, when brought into contact, of reacting in an exothermic or endothermic manner, so as to heat or cool the beverage contained in the first receptacle 2.

The first component comprises a salt which, depending on the thermal effect required, may consist of anhydrous calcium chloride (heating) or sodium thiosulphate (cooling), while the second component, in both cases, consists of water. Though the elements given above are preferred, it is also envisaged that the first component may comprise other compounds known in the technical field in question, such as calcium oxide (heating) or potassium chloride, urea or ammonium nitrate (cooling). To connect the two compartments 11, 12, and therefore bring together the respective components contained in them, a breaking device, capable when operated of tearing the diaphragm 13, is provided in the container 1.

The breaking device comprises four blades 14 extending axially in the second compartment 12 towards the diaphragm 13 and rigidly attached at a first end to the base 6 of the second receptacle 3. Each blade 14 is advantageously capable of axial deformation by bending, as explained more fully below.

Figure 3A:
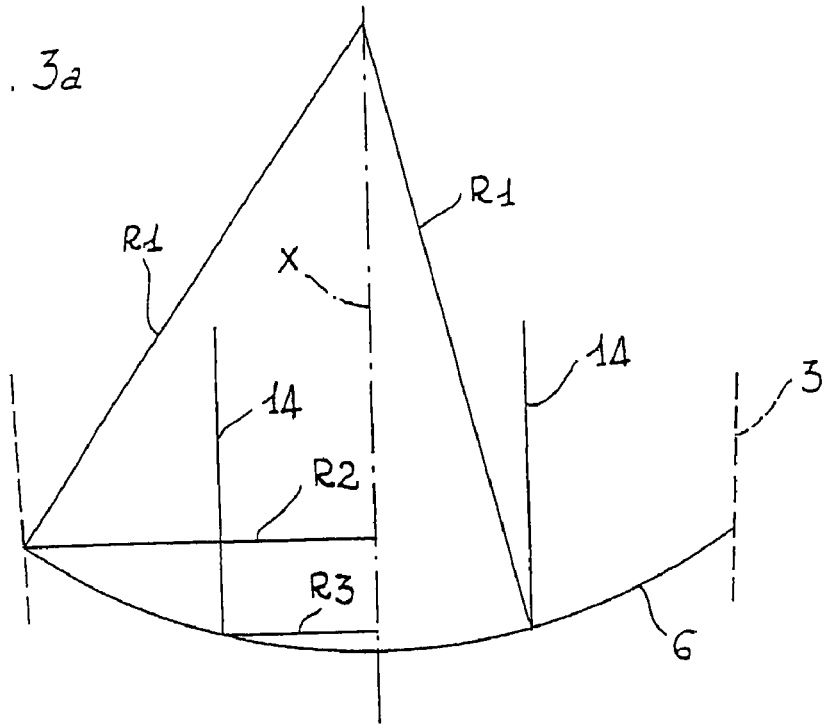
FIGS. 3*a* and 3*b* are schematic partial views to a larger scale of a detail of the container in FIG. 1, respectively in the operating positions in FIG. 1 and in FIG. 2, FIGS. 4*a* to 4*e* are schematic views of respective stages in production of the container in FIG. 1 according to a first method of manufacturing the container.
Figure 3B:
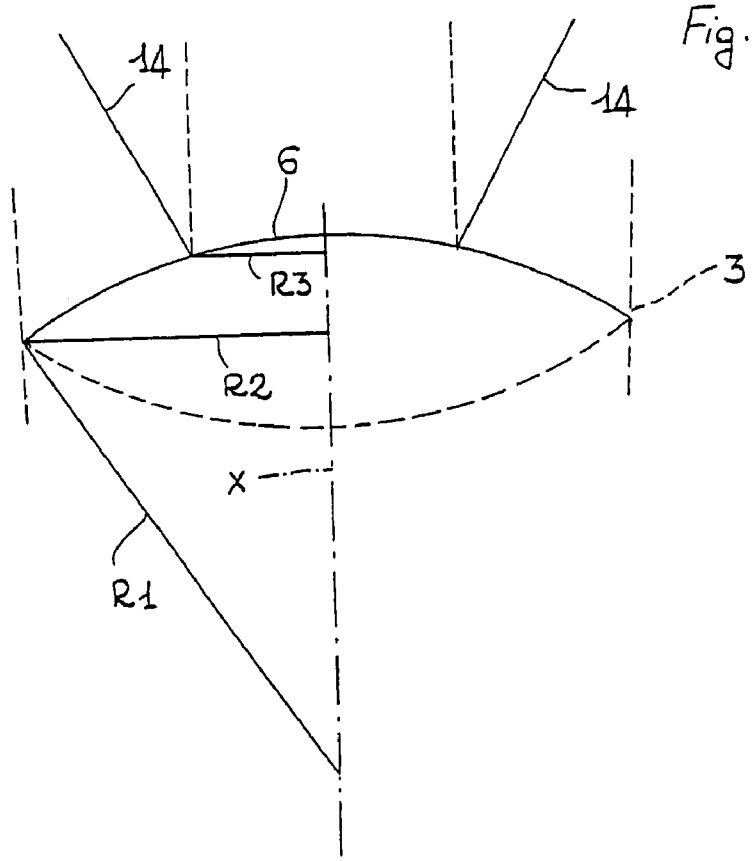

The blades 14 are arranged concentrically on the base 6 along the sides of a square and are also constructed so that they extend in a manner substantially parallel to the axis X when the base 6 is in the outwardly dished rest position (FIG. 3*a* and dashed line in FIG. 3*b*). In this way, when the base 6 is dished towards the inside, the blades 14 are moved towards the diaphragm 13 in a direction diverging from the axis X (continuous line in FIG. 3*b*).

The parameters of the geometry of the base 6 and of the blades 14 in the two positions described above have been studied in detail so as to optimize the dimensions and relative positioning of the blades, taking account in particular of the need to keep the diaphragm 13 as far as possible against the base 4 of the first receptacle 2, to allow sufficient movement of the blades in an axial direction to tear the diaphragm 13, and also to maximize the sideways movement and degree of divergence of the blades so as to be impeded by the base 4 as little as possible.

The optimum configuration emerging from this study specifies that, with a base having a curvature R1 of 75 mm and a radius R2 of 25 mm, the blades 14 are positioned at a distance from the centre R3 of between 12 and 13 mm. To assist the tearing of the diaphragm 13, the free end 15 of the blades 14 may be shaped in a point and/or have a serrated edge (not shown in the appended drawings).

Similarly, it is envisaged that the number of blades may be different from that cited (for example a single blade positioned centrally) though the arrangement described above constitutes a preferred embodiment of the invention. This embodiment operates with a limited number of blades, without incurring excessive stiffening of the base 6, at the same time ensuring that the diaphragm is torn fully and that consequently the components of the reaction mix rapidly and loss of heat to the outside is minimized.

To heat or cool the beverage contained in the first receptacle 2, it is only necessary to turn the container 1 upside down and press on the base 6 of the second receptacle 3, deforming it so that the blades 14 are moved towards the diaphragm 13, tearing it (FIG. 2).

As a consequence of the close proximity of the diaphragm 13 and the first receptacle 2, each blade 14, having only just passed beyond the diaphragm 13, may encounter the base 4 at its free end 15. Further penetration of the blades 14 into the first compartment 11 is not impeded, however, since, because of their flexibility, the blades are easily deformed and able to slide along the plane of the base 4, following the shape of the chamber 10 (FIG. 2).

As a result of the diaphragm 13 being torn and the container 1 being turned upside down, the water passes from the second compartment 12 to the first compartment 11 where it reacts with the first component delivering heat to (or absorbing it from) the surrounding area.

It should be noted that because of the number and bending of the blades 14, very extensive tearing of the diaphragm 13 occurs, thus assisting the rapid flow of the water into the first compartment 11.

The container 1 is produced by proceeding as follows.

With reference to FIGS. 4*a* to 4*e*, the first and second receptacles 2, 3 are prepared separately. The latter also comprises the blades 14 which are preferably made in one piece with the base 6.

The second component, normally water, is introduced into the second receptacle 3 and flows by gravity onto the base 6 of this receptacle. Above the free surface of the water, at the shoulder 7*a*, the diaphragm 13 is fixed, thus forming and closing the second compartment 12.

After introducing the first component in granular form above the diaphragm 13, the second receptacle 3 is rotated rapidly about its main axis X. In this way, because of the centrifugal force thus generated, the first component is pressed against the walls of the casing 7, assuming an annular formation.

Figure 4A:
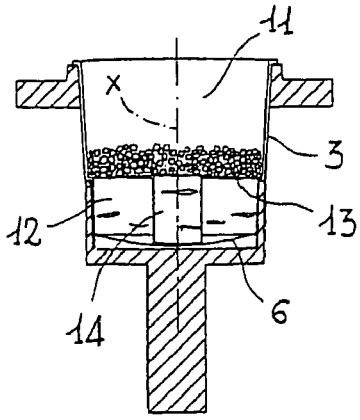
Figure 4B:
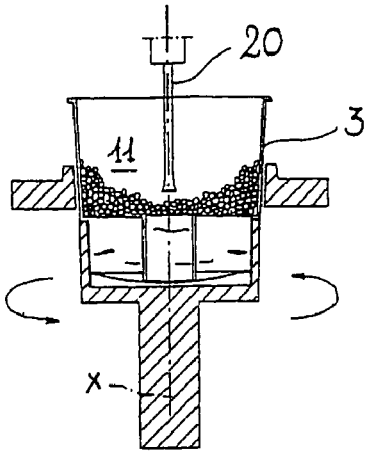
Figure 4C:
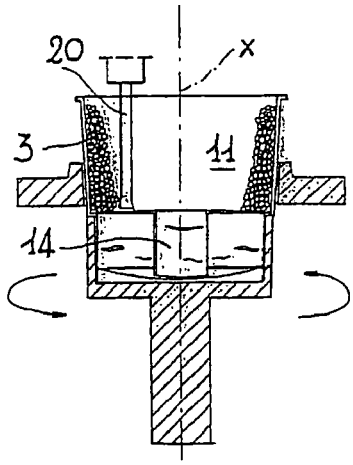

To assist in arranging the salt component correctly against the walls of the casing 7, provision is made for a deflector device 20 to be inserted into the receptacle 3 during the above phase of rotation about its own axis. The deflector is initially inserted at the axis of rotation down to a minimum distance from the diaphragm 13 (FIG. 4*b*), after which it is moved radially towards the casing 7 until it reaches a distance from the casing corresponding substantially to the thickness of the first compartment 11 (FIG. 4*c*).

This distributes the salt uniformly against the wall 7, and also maintains a substantially uniform thickness between the base and the top, even when operating at relatively low speeds of rotation, as a general indication around 500 rpm for salt components having a grain size of between 1 and 2 mm. The low speed of rotation advantageously avoids unwanted escapes of granular material from the second receptacle 3.

Figure 4D:
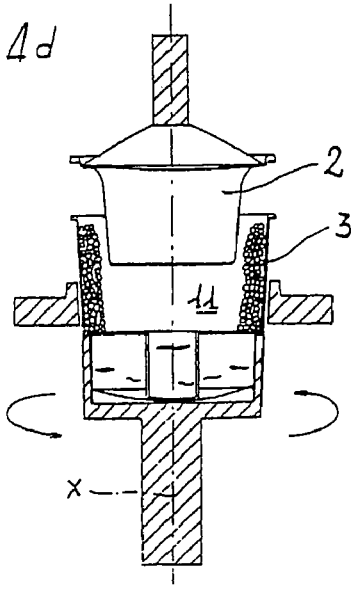
Figure 4E:
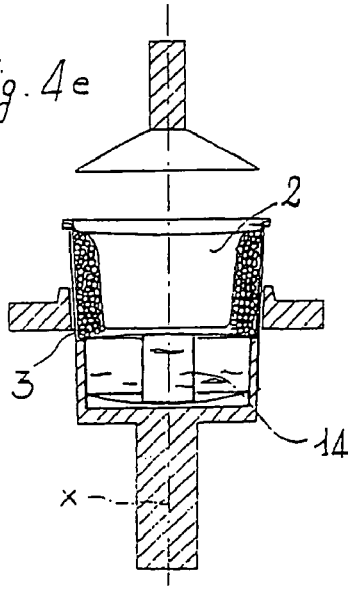

When this phase is completed, the deflector device 20 is withdrawn from the second receptacle 3, which is still made to rotate as appropriate, while at the same time the first receptacle 2 is inserted axially (FIG. 4*d*). It should be noted that, as the first component is forced against the casing 7, the first receptacle can be introduced into the first compartment 11 without being impeded by anything until the final connecting position against the diaphragm 13 is reached. In this position, the first and second receptacles 2, 3 can be attached to each other, for example by welding, at their respective mouths.

According to a first variant of the method of manufacturing the container, described here with reference to FIGS. 5*a* to 5*e*, after the first component has been put into the second receptacle 3 above the diaphragm 13, the first receptacle 2 is partially inserted into the first compartment 11.

Figure 5A:
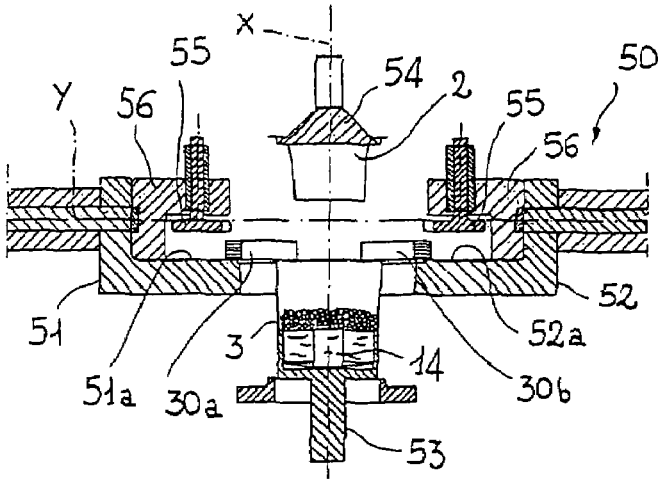
Figure 5B:
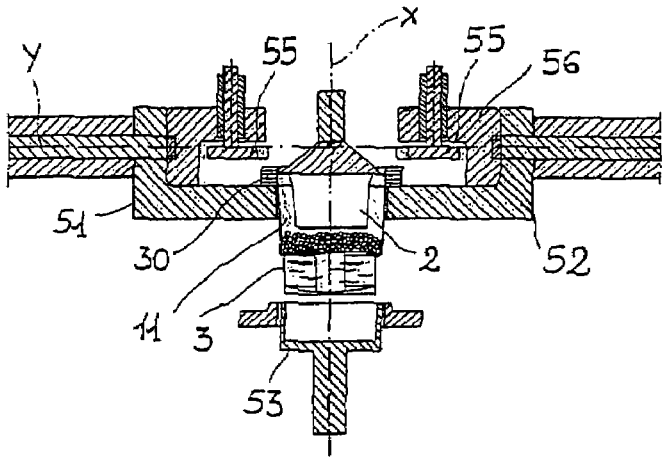

A seal 30 is arranged in annular fashion between the mouths of the first and second receptacles 2, 3 so as to close the chamber 10 to the outside at the opening which is still formed between the two receptacles 2, 3 (FIG. 5*b*).

The container 1 is then turned over through 180° about a horizontal axis, so that the mouths of the receptacles 2 and 3 are pointing downwards.

Figure 5C:
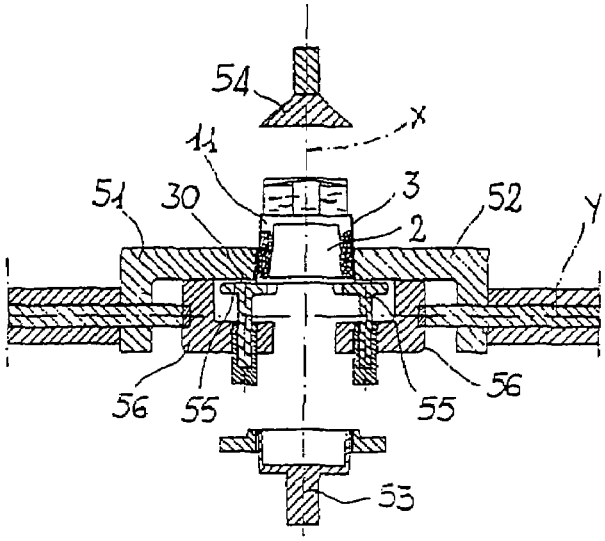

By the effect of gravity, the granular material of the first component runs down between the casings 5 and 7 of the receptacles 2 and 3, becoming arranged in an annular position around the first receptacle 2 and leaving the space between the base 4 of that receptacle and the diaphragm 13 empty (FIG. 5*c*). Escape of the granular material is prevented by the seal 30, suitably placed against the container 1 in continuation of the wall of the casing 7 and abutting against the edge of the mouth of the first receptacle 2.

At this point, the first receptacle 2 is inserted into the first compartment 11, after which the container 1 is again turned over through 180° so as to return to the starting position ready for the subsequent phase of welding between the two receptacles 2, 3.

The method proposed may be put into effect using a machine 50 comprising a pair of jaws 51, 52, semi-circular in shape, capable of moving along an axis Y alternately towards or away from each other, to grip or release the second receptacle 3 which is moved into position by a ram 53 operating parallel to the axis X of the container 1.

The second receptacle 3, into which the salt component has already been put, is held by the jaws 51, 52 so that its mouth is substantially level with the upper edges 51*a*, 52*a* of the jaws. Two half-rings 30*a*, 30*b* of the seal 30 are also arranged beforehand on the edges 51*a*, 52*a*.

Preferably, each of the two half-rings of the seal 30 comprises a pair of thin steel strips arranged on the opposite surfaces of the seal 30, between which a soft elastomer material is placed.

The first receptacle 2 is then inserted from above into the compartment 11 by means of a vacuum device 54 and then held in position inside the second receptacle 3 by a pair of plungers 55 fitted on supports 56 which slide along the axis Y.

The machine 50 is then rotated through 180° about the Y axis and when the salt component has run by gravity into the annular portion of the compartment 11, the first receptacle 2 is inserted into the compartment by means of the pair of plungers 55.

Because of the deformability of the seal 30, the latter can be suitably compressed by the plungers 55 to a thickness slightly greater than that of the surface metal strips. The machine 50 is then moved back to the starting position, where the container 1 bears on the ram 53 and the jaws 51, 52 are slightly opened so as to withdraw the seal 30 from the pair of plungers 55, thus enabling them to complete the insertion of the first receptacle 2. It should be noted that the easy withdrawal of the half-rings 30*a*, 30*b* from the action of pressure exerted by the plungers 55 is made possible by the low friction present on the opposite surfaces of the seal 30 because of the metal strips.

The jaws 51, 52 are then opened and the container 1 released onto the ram 53 which transfers it to the next phase of processing.

The container having the structural characteristics mentioned above, produced as required by one of the methods described here, has been produced in various models with various capacities.

By way of example and comparison, the table below gives the values for weight (net of the beverage) and overall volume of containers according to the invention capable respectively of containing 40 mm and 100 ml (identified in the table respectively as A40 and A100) compared with similar containers of the same capacity produced according to the prior art (identified respectively as B40 and B100).

| | A40 | A100 | B40 | B100 |
|---|---|---|---|---|
| Weight (g) | 75 | 200 | 100 | 320 |
| Volume (ml) | 150 | 310 | 230 | 670 |

As can be seen from the values indicated in the table above, the arrangement of the components in the container according to the invention makes it possible to change to larger capacity models with a limited increase in the weight and overall dimensions of the container. It should be noted that with the known structural configuration, the increases in weight and volume as a result of the increase in beverage capacity are respectively about 20% and 40% greater than the increases in weight and volume obtained with the structural configuration of the invention. This characteristic, combined with the fact that even with small quantities of beverage the container of the invention is lighter and more compact, allows containers to be produced with greater capacity for appreciably lower weight and volume compared with the known containers. The table above indicates how with a capacity of 100 ml, the weight of the container according to the invention is about 40% lighter and about 55% less bulky than the known container.

The invention therefore achieves the proposed aims, at the same time offering numerous other advantages, among them a saving in production costs, attributable substantially to the smaller quantity of plastics material required to produce the second receptacle (estimates by the applicant indicate a saving in plastics material of about 30% for the 40 ml container and about 70% for the 100 ml container).

Moreover, with the arrangement of the components described above, the overall thermal efficiency of the reaction is improved since, as the thermal capacity of the container is reduced, the proportion of the heat developed (or absorbed) by the reaction which is used to heat (or cool) the beverage is greater.

I claim:

1. A self-heating or self-cooling container, particularly for beverages, comprising a first receptacle (2) having a base (4)

containing said beverage and inserted in a second receptacle (3) having a base (6), a first compartment (11) formed between the first and the second receptacle and a second compartment (12) formed on the base (6) of the second receptacle (3) and separated from the first compartment (2) by a breakable diaphragm (13), at least a first and a second component of an exothermic or endothermic reaction being arranged separately and respectively in said compartments, characterized in that said first component is arranged in said first compartment (11) annularly about said first receptacle (2), said diaphragm (13) extending, to separate said compartments, substantially against the base (4) of said first receptacle (2), in which there extends in said second compartment (12) a breaking device (14), capable when operated of moving in order to break said breakable diaphragm (13), said breaking device being at least partially deformable when one of said receptacles (2,3) is encountered.

2. The container according to claim 1, in which said breaking device comprises at least one blade (14) integral with an inward-flexing base (6) of said second receptacle (3) and extending in said second compartment (12) towards said first receptacle (2).

3. The container according to claim 2, in which said at least one blade (14) is deformable by bending.

4. The container according to claim 2, in which said breaking device comprises four blades (14) standing upright concentrically from said inward-flexing base (6) towards said diaphragm (13).

5. The container according to claim 4, in which, when said base (6) is in an outward-dished position, said blades (14) extend parallel to the axis (X) of said receptacles.

6. The container according to claim 5, in which, the inward-flexing base (6) has a radius of about 25 mm and a curvature of about 75 mm, said blades (14) are positioned on said inward-flexing base at a distance of between 12 mm and 13 mm from the centre of said inward-flexing base.

7. The container according claim 2, in which a free end of said at least one blade (14) close to said diaphragm (13) is shaped in a point.

8. The container according to claim 7, in which said at least one blade (14) comprises a serrated edge at said free end.

9. A self-heating or self-cooling container, particularly for beverages, comprising a first receptacle (2) having a base (4) containing said beverage and inserted in a second receptacle (3) having a base (6), a first compartment (11) formed between the first and the second receptacle and a second compartment (12) formed on the base (6) of the second receptacle (3) and separated from the first compartment (2) by a breakable diaphragm (13), at least a first and a second component of an exothermic or endothermic reaction being arranged separately and respectively in said compartments, characterized in that said first component is arranged in said first compartment (11) annularly about said first receptacle (2), said diaphragm (13) extending, to separate said compartments, substantially against the base (4) of said first receptacle (2), in which said first component is in the form of a granular solid and said second component is a liquid.

10. The container according to claim 9, in which said first component is selected from the group consisting of anhydrous calcium chloride, calcium chloride, urea and sodium thiosulphate, and said second component is water.

11. A method of manufacturing a self-heating or self-cooling container, particularly for beverages, comprising the steps of:

arranging a first receptacle (2) having a base (4) and a second receptacle (3) having a base (6), such that the first receptacle is capable of being inserted into the second receptacle, thus forming a closed chamber (10) between said receptacles, arranging between the base (4) of the first receptacle and the base (6) of the second receptacle a breakable diaphragm (13) subdividing said chamber (10) into a first compartment (11) formed between the first and the second receptacle and into a second compartment (12) formed on the base (6) of the second receptacle (3), and arranging separately in said compartments (11,12) respectively a first and a second component capable of exothermic or endothermic reaction when placed in contact with each other, characterized in that said first component is arranged in said first compartment (12) in an annular position around said first receptacle (2) and said diaphragm (13) is arranged against the base (4) of said first receptacle.

12. The method according to claim 11, in which said first component is arranged in said annular position as a result of a rapid rotation of the second receptacle (3) about a main axis (X) of the receptacle, so that the first component is pressed by the effect of the centrifugal force resulting from said rotation against the side casing (7) of the second receptacle, the first receptacle (2) being inserted into the position of connection to the second receptacle (3) during said rotation.

13. The method according to claim 12, in which, during the rotation phase, a deflector device (20) is inserted into said second receptacle (3) to assist the positioning of said first component against the side casing (7) of the second receptacle (3).

14. The method according to claim 13, in which said deflector device (20) is inserted axially into said second receptacle (3) and is then moved radially towards said side casing (7) up to a distance equal to the thickness required to arrange said first component in said annular position around said first receptacle (2).

15. The method according to claim 13, in which said first component has a grain size of between 1 and 2 mm and said second receptacle is made to rotate at a speed of about 500 rpm.

16. The method according to claim 11, in which said first component is arranged in said annular position as a result of the following steps:

positioning the second receptacle (3) with the mouth upwards and arranging the first component in the first compartment (11), partially inserting the first receptacle (2) into the second receptacle (3) and arranging a seal (30) between said receptacles so as to close to the outside the chamber (10) formed between them, simultaneously inverting and positioning said receptacles (2,3) with their respective mouths downwards, in such a way that the first component flows down by gravity around the casing (5) of the first receptacle (2) in said annular position, and inserting the first receptacle (2) into the second receptacle (3), while said receptacles are in the position defined in the preceding step.

17. The method according to claim 16, in which said seal (30) is placed against said receptacles so that it abuts against the edge of the mouth of the first receptacle (2) and is adjacent to the second receptacle (3) in continuation of the casing (7) of that receptacle.

18. The method according to claim 17, in which said seal (30) is produced from elastic material and is compressed during said phase of insertion of the first receptacle into the second receptacle.

* * * * *